US005638878A

United States Patent [19]

Weirathmueller

[11] Patent Number: 5,638,878

[45] Date of Patent: Jun. 17, 1997

[54] LOG DEBARKING APPARATUS

[75] Inventor: Friedrich Weirathmueller, Nackawic, Canada

[73] Assignee: Valley Machine Works Ltd., Nackawic, Canada

[21] Appl. No.: 676,502

[22] Filed: Jul. 8, 1996

[51] Int. Cl.[6] ..... B27L 1/04

[52] U.S. Cl. ..... 144/208.6; 144/208.1; 144/250.25; 144/341; 414/776; 414/779

[58] Field of Search ..... 144/208.1, 208.6, 144/242.1, 250.25, 341; 414/685, 745.2, 749, 776, 779

[56] References Cited

U.S. PATENT DOCUMENTS

| | | | |
|---|---|---|---|
| 2,611,401 | 9/1952 | Burton | 144/208.6 |
| 2,841,195 | 7/1958 | Fulghum | 144/208.6 |
| 3,082,801 | 3/1963 | Dillingham | 144/208.6 |
| 3,176,734 | 4/1965 | Broadbent | 144/208.6 |
| 3,267,476 | 8/1966 | Keeney | 144/208.6 |
| 4,249,585 | 2/1981 | Mellott | 144/208 |

FOREIGN PATENT DOCUMENTS

| | | |
|---|---|---|
| 642006 | 5/1962 | Canada . |
| 659666 | 3/1963 | Canada . |
| 683768 | 4/1964 | Canada . |

*Primary Examiner*—W. Donald Bray
*Attorney, Agent, or Firm*—Mario D. Theriault

[57] ABSTRACT

An improved log debarking apparatus characterized by a pair of shafts with cleated wheels for supporting and rotating a log under a rosser type debarking tool. The improved log debarking apparatus further has a plurality of log lifters movably supported about a common axis, and each having a profiled upper edge engageable transversally with a lower surface of a log on the cleated wheels. There is also provided a first lifter actuating means for alternately turning the log lifters from a retracted position below a radial projection of the cleated wheels, to a raised position above the cleated wheels, and into a log ejecting position wherein each profiled upper edge is inclined for rolling the log along and away from the cleated wheels. There is further provided a second lifter actuating means for moving the plurality of log lifters longitudinally relative to the shafts. The present invention also relates to a method for debarking a log, comprised of the following steps: raising the log above the cleated wheels; moving the log until a large lump on a surface of that log is positioned beside any of the wheels; laying the log back onto the wheels; and rotating the wheels and the log, and debarking the log.

20 Claims, 4 Drawing Sheets

LOG DEBARKING APPARATUS

FIELD OF THE INVENTION

The present invention relates to log debarking apparatus and more particularly, it relates to a log debarking apparatus characterized by a pair of shafts with cleated wheels for supporting and rotating a log under a rosser type debarking tool, further having a log lifting and moving means for longitudinally positioning a log on the cleated wheels.

BACKGROUND OF THE INVENTION

When sawing lumber, the residual slabs, edgings and trimmings are usually chipped and delivered to a pulp mill for making paper pulp. Bark is normally not allowed in a pulping process for being difficult to bleach and therefore for showing as impurities on the finished paper products. For this important reason amongst many, logs entering a sawmill are generally stripped of their bark at an early stage in the lumber sawing operation.

One type of log debarking apparatus which is well known in the lumber industry is illustrated and described in U.S. Pat. No. 4,249,585 issued on Feb. 10, 1981 to Hayes R. Mellott. This rosser type machine has a pair of shafts on which is mounted a plurality of cleated wheels. A log is positioned on the wheels and is rotated while a carriage travels on a track along the machine. A rotating toothed roller mounted on this carriage scrapes the bark off the log.

One drawback with this type of machine is that when a lump or a large branch socket rotates on one of the wheels, the log is suddenly displaced from its normal axis of rotation. When this happens, several wheels adjacent to the hump are not in contact with the log surface, often causing a slipping of the wheels and an uneven rotation of the log. These sudden movements and uneven rotation of the log cause the debarking tool to jump, skip, or otherwise operate in an inconsistent manner, leaving bark at some places and gouging into the surface of the log at other locations.

It is a common trend in the lumber industry nowadays to strive at increasing the yield of every tree. The thickness of slabs is continuously reduced, and electronic optimizers are used to calculate the best combination of lumber pieces available from a given diameter log. Therefore a deep groove left by the debarking tool on the surface of a log is sometimes detrimental to an ideal recovery of lumber from that log.

Another common modem practice in the lumber industry is that quality inspections carried out at a lumber mill as well as by purchaser's associations are more and more stringent. Hence, a single deep groove left on the surface of a log by a debarking tool may sometimes degrade a piece of lumber taken from this log to a fraction of its normal value. Similarly, a load of wood chips containing bark in excess of a minimum standard is generally rejected entirely by a pulp mill or a penalty is imposed on the supplier.

For all these reasons, the debarking of logs is a very important part of a lumbering process. The recovery of lumber from a log, and the quality of wood chips obtained from slabs, edgings and trimmings depends greatly upon a good operation of the debarking apparatus at the infeed end of a sawmill. In this respect, the rosser type debarking apparatus of the prior art is restricted in its debarking performance by the aforesaid erratic rotation of logs.

SUMMARY OF THE INVENTION

In the present invention, however, there is provided an improved rosser type log debarking apparatus having lifting and moving means for positioning a log longitudinally relative to the log supporting wheels. The lifting and moving means is operated to move a log such that all humps or branch sockets projecting from the surface of that log are located beside the log supporting wheels. A log is thereby reliably rotated about its true longitudinal axis and the debarking operation is carried out in a smooth and efficient manner.

In one aspect of the present invention, the log debarking apparatus comprises an elongated rigid structural frame with a pair of rotatable, spaced apart and parallel elongated shafts. These shafts are mounted longitudinally on the rigid structural frame and each has a plurality of spaced apart wheels for supporting and rotating a log about its longitudinal axis.

The apparatus also comprises a driven rotary debarking tool for removing bark from a log being rotated on the log supporting wheels, a debarker tool carriage supporting the debarking tool for movement along the length of the log, and track means for supporting the carriage for movement along a path substantially parallel to, and spaced from, a log on the log supporting wheels.

There is also provided a movable tool support arm means mounted on the carriage and projecting laterally from the track means in position to support the debarking tool above the structural frame, and means for driving the carriage along the track means.

The improvement in the log debarking apparatus thus described comprises a plurality of log lifters being each movably supported on the structural frame between a pair of adjacent log supporting wheels. Each of the log lifters has a profiled upper edge engageable transversally with a surface of a log. There is also provided a first lifter actuating means for alternately moving the log lifters from a retracted position below a radial projection of the log supporting wheels, when viewed from an end of said structural frame, to a raised position above the log supporting wheels, and vice versa.

The improvement further comprises a second log lifter actuating means for moving the log lifters longitudinally relative to the structural frame, and control means for controlling the first and second lifter actuating means.

A primary advantage of this aspect of the present invention is that an operator of this log debarking apparatus can raise a log having a hump or a branch socket projecting for a surface thereof above the log supporting wheels. This operator can move and lay that log on the log supporting wheels such that individual large hump or branch socket is beside any of the log supporting wheels. The log is thereby rotated continually by the log supporting wheels about its true longitudinal axis. Hence, the log is peeled in an efficient manner and the debarking tool does not adversely gouge its surface.

In accordance to another aspect of the present invention, there is provided log lifters which are rigidly attached to a common axis. This common axis is pivotally mounted into a plurality of bearing blocks affixed to the track means. The first lifter actuating means comprises a pair of first and second actuators cooperating with one another for rotating the common axis and all log lifters about the bearing blocks, from the retracted position, to the raised position and into a log ejecting position. When the log lifters are in the log ejecting position, the profiled upper edge of each log lifter is inclined for rolling the log along and away from the log supporting wheels.

Each profiled upper edge has a shoulder portion having a radial dimension from the common axis of rotation of the log lifters which is greater than a height of the track means above the common axis. When the log lifters are rotated in the log ejecting position, a log rolling on the shoulder portion is transversally movable over the track means. The log lifters oft he present invention have thereby the dual utilities of positioning a log on the log supporting wheels, and of ejecting a log from the debarking apparatus upon completion of a debarking process.

BRIEF DESCRIPTION OF THE DRAWINGS

The preferred embodiment of the invention will be further understood from the following description, with reference to the drawings in which.

DETAILED DESCRIPTION OF THE PREFERRED EMBODIMENT

Figure 1:
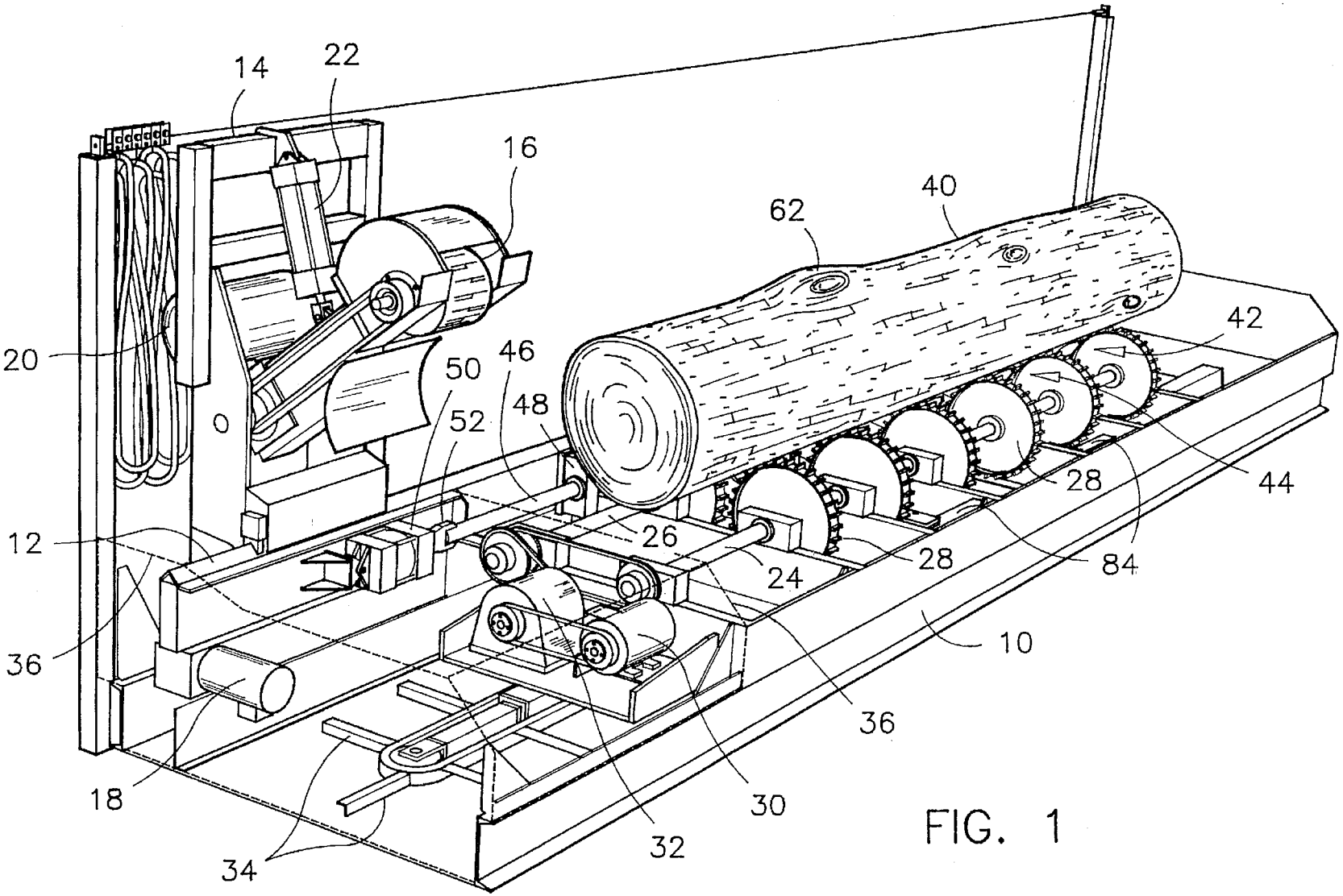
FIG. 1 is a perspective front, left side and top view of a rosser type log debarking apparatus having longitudinal log positioning means.
Figure 2:
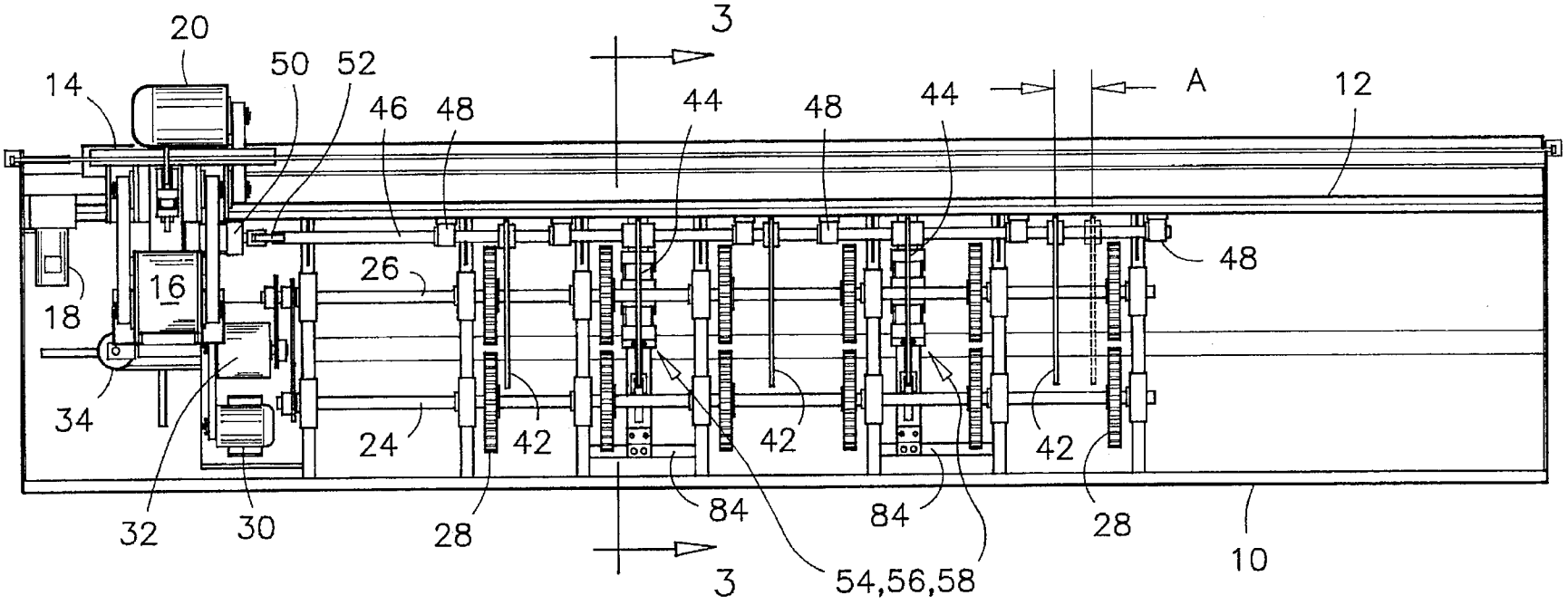
FIG. 2 is a top view of the log debarking apparatus of FIG. 1.

Referring to FIGS. 1 and 2, a rosser type log debarking apparatus of the preferred embodiment generally comprises a rigid structural frame 10, having an inverted V-shaped rail 12 along substantially the full length thereof. The debarking apparatus also comprises a carriage 14 movably mounted on the rail 12, and supporting a rotatable debarking tool 16.

The carriage 14 is driven along the rail 12 by a first electric motor 18. The debarking tool 16 is driven by a second electric motor 20 and power transmission belts, and is actuated in a generally up and down direction by a pneumatic cylinder 22.

The log debarking apparatus has a pair of parallel shafts 24,26, each having a number of cleated wheels 28. Both shafts 24,26 are rotated in a same direction by a drive arrangement generally comprising a third electric motor 30, a gear reducer 32, and drive chains and sprockets. The bottom portion of the structural base frame 10 may also have a bark evacuating system 34 which is partly illustrated in FIG. 1.

The log debarking apparatus preferably has a sheet-metal cover 36 covering the drive arrangement. This cover 36 is shown in FIG. 1 in dashed lines to provide better clarity and understanding of the drawing.

A log 40 is loaded on the log debarking apparatus by rolling it over a first set of cleated wheels 28 on shaft 24, until it rests on both sets of cleated wheels 28 as illustrated in FIG. 1. This is done by a log feeder of the conventional type which is not illustrated herein as it is well known to persons of this industry. When a debarking operation is completed, the log is rolled over the other set of cleated wheels on shaft 26, onto an outfeed log conveyor of a similar conventional type, for further processing into lumber.

The log debarking apparatus of the preferred embodiment has a series of log lifters 42,44 connected to an actuator shaft 46 which is movably and pivotally mounted into a plurality of beating blocks 48. These bearing blocks 48 are preferably mounted on the inverted V-shaped rail 12. The bearing blocks 48 are of the sleeve type wherein shaft 46 is free to slide therein along its longitudinal axis.

The actuator shaft 46 is connected at a drive end to a pneumatic cylinder 50 as illustrated in FIG. 1, by means of a clevis joint 52 which is preferably adapted for swivelling about the longitudinal axis of shaft 46. The cylinder 50 preferably has a stroke length of about eight inches whereby all log lifters 42,44 are movable longitudinally a distance as shown as 'A' in FIG. 2 of about eight inches.

Figure 4:
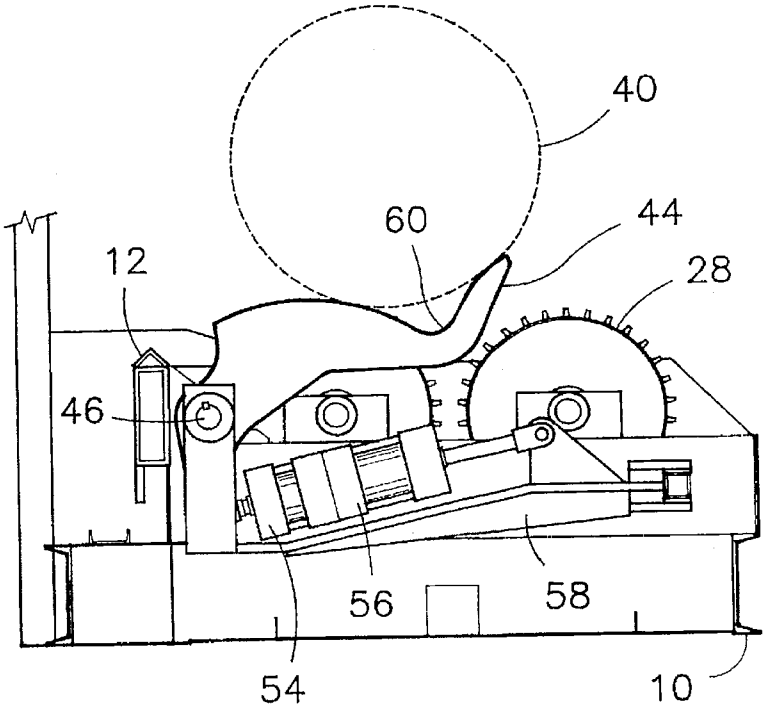
FIG. 4 is also a cross-section of the log debarking apparatus in which a log lifter is in a raised position.
Figure 3:
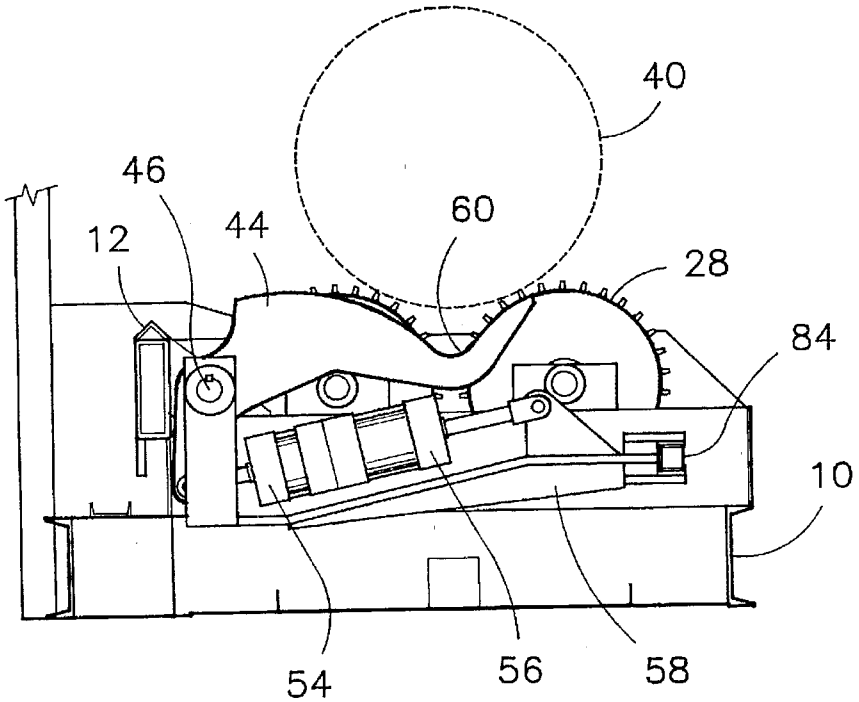
FIG. 3 is a cross-section view of the log debarking apparatus, along line 3—3 of FIG. 2 in which a log lifter is in a retracted position.
Figure 5:
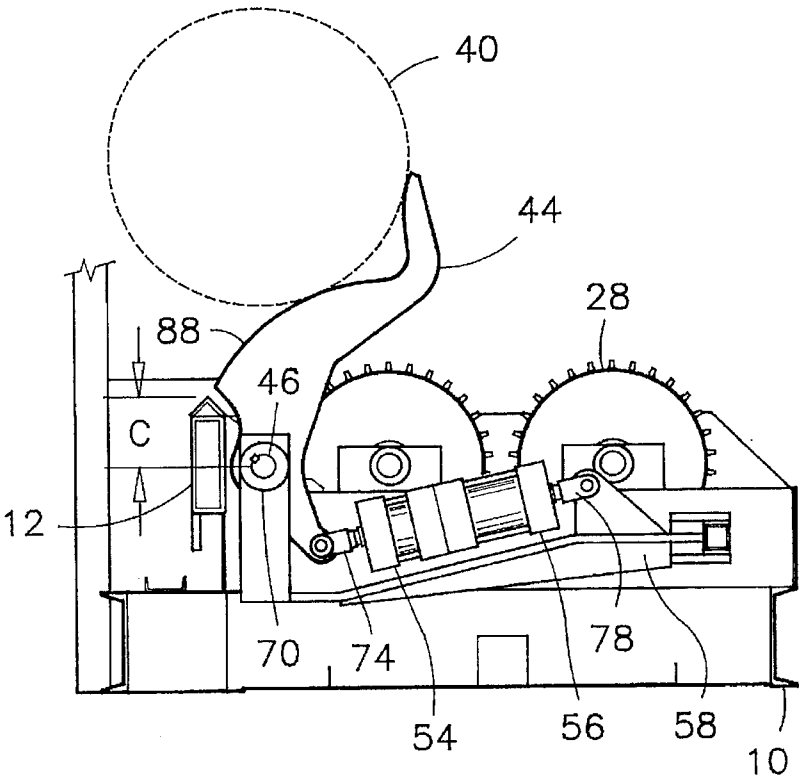
FIG. 5 is further a cross-section of the log debarking apparatus wherein a log lifter is in a log ejecting position.

Referring now to FIGS. 3, 4 and 5, the log lifters 42,44 are actuated in an up and down angular movement about shaft 46 by a pair of lifter actuators comprising each of a lifter cylinder 54 and an ejector cylinder 56. The two cylinders 54, 56 are mounted in a back-to-back arrangement on an actuator support bracket 58.

When the rods of both cylinders 54,56 are fully extended, the lifter arm 44 is in a lowermost retracted position as shown in FIG. 3. When the rod of lifter cylinder 54 is retracted, the lifter arm 44 is in a raised position as shown in FIG. 4. And when the rods of both cylinders 54,56 are retracted, the lifter arm 44 is in an uppermost log ejecting position as shown in FIG. 5.

Each log lifter 42, 44 has a V-shaped profile 60 to support and retain a log therein when the log lifters 42, 44 are in a raised position. Hence, when the log lifters 42, 44 are in this intermediate position, a log 40 supported thereby is raised above the cleated wheels 28.

During use of the log debarking apparatus of the present invention, a person operating this apparatus can activate lifter cylinders 54 and mover cylinder 50 to position a log 40 relative to the cleated wheels 28 such that any pair of adjacent cleated wheels 28 are positioned astride large lumps 62 on this log 40. A typical lump 62 is illustrated in FIG. 1.

An operator may further successively activate the lifter cylinder 54 and the mover cylinder 50 in and out several times to move a log a distance of sixteen inches or more, for example until most lamps 62 on that log 40 are positioned beside any of the cleated wheels 28.

When large irregularities of a log surface are positioned between or beside the cleated wheels 28 of the log debarking apparatus of the preferred embodiment, a log rotates about its longitudinal axis in a more consistent manner. The debarking head 16 remains at a similar height throughout the debarking process, and the rotational speed of the log is steadier than for conventional log debarking apparatus. Hence, a log peeled on the machine of the preferred embodiment has less bark and grooves on its surface than logs peeled on conventional machines.

Figure 6:
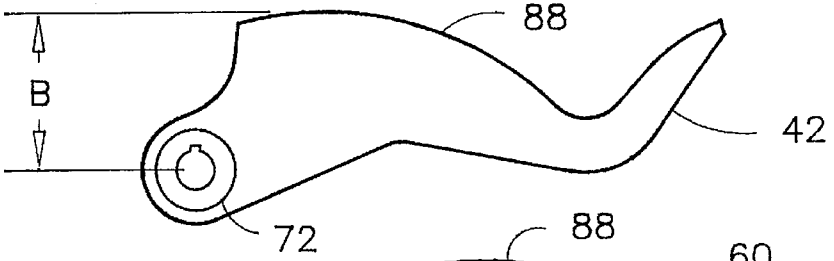
FIG. 6 is a side view of a driven log lifter.
Figure 7:
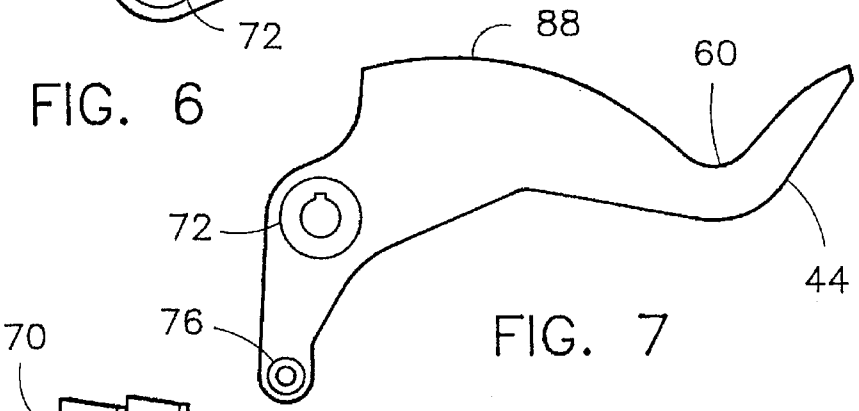
FIG. 7 is a side view of an active log lifter.
Figure 8:
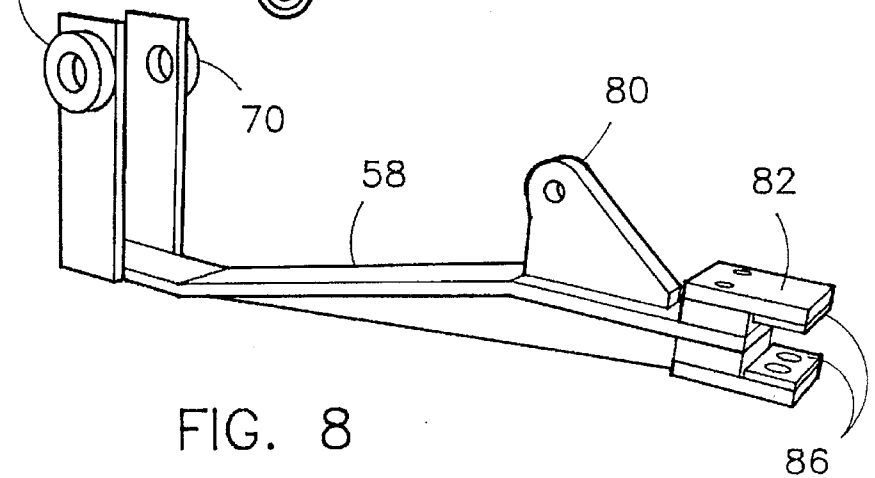
FIG. 8 is a perspective front, left side and top view of a lifter actuator support bracket.

Referring now to FIGS. 6, 7 and 8, the actuator support frame 58 has on a first end thereof a pair of hollow bosses 70 dimensioned to movably fit on the shaft 46. The actuator support frame 58 is mounted on shaft 46 with each boss 70 being positioned on a respective side of a keyed sleeve 72 of a log lifter 44. Keyed sleeve 72 is lockable on shaft 46 in a manner common in this trade; that is with a tapered key, set screws, power lock devices or the like. Each actuator support frame 58 is thereby movable sideways with shaft 46 and each log lifter 44.

A first clevis 74 on the lifter cylinder 54 connects into an eyed leg member 76 on an active log lifter 44. A second clevis 78 on the ejector cylinder 56 connects into a holed bracket 80 on a far end of the actuator support bracket 58 opposite the mounting bosses 70. Active log lifters 44 have an eyed leg member 76 required for connecting to each lifter actuator 54 while driven log lifters 42 without leg member may be used as required along shaft 46.

During longitudinal movement of each actuator support bracket 58, the far end thereof is guided by means of a C-clamp 82 dimensioned and adapted for sliding onto a horizontal guide bar 84 attached to the structural base frame 10, as is better illustrated in FIGS. 1 and 2. For this purpose, C-clamp 82 preferably has sliding shoes 86 made of a plastic material.

Each of the log lifters 42,44 has a shoulder portion 88 which is spaced from the keyed sleeve 72 a radial distance shown as 'B'. Distance 'B' is at least as much as a distance 'C' in FIG. 5 that is, from the shaft 46 to the top portion of the inverted V-shaped rail 12.

When a log debarking operation is completed, a person operating this apparatus may cause both pairs of lifter cylinders 54 and ejector cylinders 56 to retract their rods as shown in FIG. 5, to raise log 40 and make it roll downward along the shoulder portion 88 of each lifters 42,44 and onto an outfeed conveyor (not shown). The height 'B' of shoulder portions 88 ensures that a log 40 being ejected from this log debarking apparatus rolls over, without impinging the inverted V-shaped rail 12.

All cylinders 22, 50, 54 and 56, are preferably of the pneumatic type. Hydraulic power could work just as well but these systems are known to drip hydraulic oil especially when in use for some time. Bark from a debarking process is often used as fuel for boilers, as horticultural mulch and in composts. For environmental reasons, hydraulic oils are generally not tolerated in these products.

The structural arrangements of all movable elements of the log debarking apparatus thus described, provides sufficient mechanical advantage and enough space to accommodate larger pneumatic cylinders. Hence, the log debarking apparatus of the preferred embodiment with electric motors and pneumatic cylinders is more environmentally acceptable than a conventional machine using a hydraulic system.

While the above description provides a full and complete disclosure of the preferred embodiment of this invention, various modifications, alternate constructions, and equivalents may be employed without departing from the true spirit and scope of the invention. Such changes might involve alternate materials, components, structural arrangements, sizes, operational features or the like. Therefore the above description and illustrations should not be construed as limiting the scope of the invention which is defined by the appended claims.

I claim:

1. A log debarking apparatus comprising:

an elongated rigid structural frame;

a pair of rotatable parallel and spaced apart elongated shafts mounted longitudinally on said rigid structural frame, each of said shafts having a plurality of spaced apart wheels for supporting a log at a substantially fixed location;

a first drive means for rotating said shafts and said wheels in a common direction, and thereby for rotating the log about its axis;

a driven rotary debarking tool for removing bark from a log being rotated on said wheels;

a debarker tool carriage supporting said debarking tool for movement along the length of a log being rotated on said wheels;

track means on said structural frame for supporting the carriage for movement along a path substantially parallel to and spaced from a log on said wheels;

movable tool support arm means mounted on said debarker tool carriage above said wheels and projecting laterally from said track means in position to support said debarking tool above said structural frame; and a second drive means for driving the carriage along said track means;

wherein the improvement comprises:

a plurality of log lifters being each movably supported on said structural frame beside one of said wheels, each of said log lifters having a profiled upper edge engageable transversally with a lower surface of a log on said wheels;

a first lifter actuating means connected to said plurality of log lifters and to said structural frame, for alternately moving said plurality of log lifters from a retracted position below a radial projection of said wheels when viewed from an end of said structural frame, to a raised position above said radial projection, and vice versa;

a second lifter actuating means connected to said plurality of log lifters and to said structural frame, for moving said plurality of log lifters longitudinally relative to said structural frame; and control means for controlling an operation of said first and second lifter actuating means;

whereby a person operating said control means can raise a log having a hump projecting from a surface thereof above said wheels, and move and lay said log on said wheels such that said hump is beside any of said wheels.

2. The improved log debarking apparatus as claimed in claim 1 wherein all said log lifters are rigidly mounted on a common axis, said common axis is movably mounted in a plurality of beating blocks on said structural frame, and said second lifter actuating means is connected to said plurality of log lifters through a joint on an end of said common axis.

3. The improved log debarking apparatus as claimed in claim 2 wherein said bearing blocks are of the sleeve type bearings such that said common axis is free to slide therein.

4. The improved log debarking apparatus as claimed in claim 1 wherein said profiled upper edge has a V-shaped conformation engageable with a surface of a log.

5. The improved log debarking apparatus as claimed in claim 2, wherein said second lifter actuating means is a pneumatic cylinder.

6. The improved log debarking apparatus as claimed in claim 2 wherein said joint is a swivel joint.

7. The improved log debarking apparatus as claimed in claim 1 wherein said second lifter actuating means has a stroke length of about eight inches.

8. The improved log debarking apparatus as claimed in claim 2 wherein said first lifter actuating means is a pair of actuator units each having a first and second actuators and an actuator support member, said first and second actuators cooperating with one-another for rotating said common axis and said log lifters about said bearing blocks, from said retracted position, to said raised position and into a log ejecting position wherein said profiled upper edge is inclined for rolling said log along and away from said wheels.

9. The improved log debarking apparatus as claimed in claim 8 wherein said bearing blocks are affixed to said track means; and each of said profiled upper edges has a shoulder portion having a radial dimension from said common axis which is greater than a height of said track means above said common axis;

whereby when said log lifters are rotated in said log ejecting position, a log rolling thereon is transversally movable over said track means.

10. The improved log debarking apparatus as claimed in claim 8 wherein said first and second actuators are two cylinders mounted back-to-back on said actuator support member;

said two cylinders mounted back-to-back have a first rod clevis attached to an eyed leg member on one of said log lifters, and a second rod clevis attached to a holed bracket on said actuator support member.

11. The improved log debarking apparatus as claimed in claim 10 wherein said two cylinders mounted back-to-back are pneumatic cylinders.

12. The improved log debarking apparatus as claimed in claim 10 wherein said structural frame has a first and second guide bar mounted longitudinally thereon; and said actuator support member has on a first end thereof a pair of hollow bosses movably mounted on said common axis astride said one of said log lifters, and on a second end thereof a C-clamp movably engaged onto one of said guide bar.

13. The improved log debarking apparatus as claimed in claim 12 wherein said C-clamp has sliding shoes made of a plastic material.

14. The improved log debarking apparatus as claimed in claim 12 wherein said plurality of log lifters is a group of five log lifters wherein said one of said log lifters having said eyed leg member is one of a second and fourth log lifters of said group.

15. A log debarking apparatus comprising:

an elongated rigid structural frame;

a pair of rotatable parallel and spaced apart elongated shafts mounted longitudinally on said rigid structural frame, each of said shafts having a plurality of spaced apart wheels for supporting a log at a substantially fixed location;

a first drive means for rotating said shafts and said wheels in a common direction, and thereby for rotating the log about its axis;

a driven rotary debarking tool for removing bark from a log being rotated on said wheels;

a debarker tool carriage supporting said debarking tool for movement along the length of a log being rotated on said wheels;

track means on said structural frame for supporting the carriage for movement along a path substantially parallel to and spaced from a log on said wheels;

movable tool support arm means mounted on said debarker tool carriage above said wheels and projecting laterally from said track means in position to support said debarking tool above said structural frame; and a second drive means for driving the carriage along said track means;

wherein the improvement comprises:

a plurality of log lifters being each movably supported on said structural frame beside one of said wheels, each of said log lifters having a profiled upper edge engageable transversally with a lower surface of a log on said wheels;

a first lifter actuating means connected to said plurality of log lifters and to said structural frame, for alternately moving said plurality of log lifters from a retracted position below a radial projection of said wheels when viewed from an end of said structural frame, to a raised position above said radial projection, and into a log ejecting position wherein said profiled upper edge is inclined for rolling said log along and away from said wheels;

a second lifter actuating means connected to said plurality of log lifters and to said structural frame, for moving said plurality of log lifters longitudinally relative to said structural frame; and control means for controlling an operation of said first and second lifter actuating means;

whereby a person operating said control means can raise a log having a hump projecting from a surface thereof above said wheels, and move and lay said log on said wheels such that said hump is beside any of said wheels, and roll said log away from said wheels upon completion of a debarking operation.

16. The improved log debarking apparatus as claimed in claim 15 wherein all said log lifters are rigidly mounted on a common axis, said common axis is movably mounted in a plurality of bearing blocks affixed to said track means; and each of said profiled upper edges has a shoulder portion having a radial dimension from said common axis which is greater than a height of said track means above said common axis;

whereby when said log lifters are rotated in said log ejecting position, a log rolling thereon is transversally movable over said track means.

17. The improved log debarking apparatus as claimed in claim 16 wherein said first lifter actuating means is a pair of actuator units each having a first and second actuators and an actuator support member, said first and second actuators cooperating with one-another for rotating said common axis and said log lifters about said bearing blocks, from said retracted position, to said raised position and into said log ejecting position.

18. The improved log debarking apparatus as claimed in claim 17 wherein said first and second actuators are two cylinders mounted back-to-back on said actuator support member;

said two cylinders mounted back-to-back have a first rod clevis attached to an eyed leg member on one of said log lifters, and a second rod clevis attached to a holed bracket on said actuator support member.

19. The improved log debarking apparatus as claimed in claim 18 wherein said structural frame has a first and second guide bar mounted longitudinally thereon;

said plurality of log lifters is a group of five log lifters wherein said one of said log lifters having said eyed leg member is one of a second and fourth log lifters of said group; and said actuator support member has on a first end thereof a pair of hollow bosses movably mounted on said common axis astride said one of a second and fourth log lifters, and on a second end thereof a C-clamp movably engaged onto one of said guide bar.

20. A method for debarking a log on a log debarking machine characterized by a pair of spaced apart horizontal parallel shafts each having a plurality of spaced apart rotatable wheels for supporting and rotating said log under a debarking tool which is movable along said log, said log debarking machine further having a plurality of log lifters engageable under said log, and movable generally vertically and along said horizontal parallel shafts; said method comprising the steps of:

raising said log above said log supporting wheels;

moving said log until a large lump on a surface of said log is positioned beside any of said wheels;

laying said log back onto said wheels; and rotating said wheels and said log, and debarking said log.

* * * * *